US007243065B2

(12) United States Patent
Stephens et al.

(10) Patent No.: US 7,243,065 B2
(45) Date of Patent: Jul. 10, 2007

(54) LOW-COMPLEXITY COMFORT NOISE GENERATOR

(75) Inventors: James Allen Stephens, Chandler, AZ (US); David L. Barron, Scottsdale, AZ (US); Sean S. You, Tempe, AZ (US)

(73) Assignee: FreeScale Semiconductor, Inc, Austin, TX (US)

( * ) Notice: Subject to any disclaimer, the term of this patent is extended or adjusted under 35 U.S.C. 154(b) by 858 days.

(21) Appl. No.: 10/408,996

(22) Filed: Apr. 8, 2003

(65) Prior Publication Data

US 2004/0204934 A1 Oct. 14, 2004

(51) Int. Cl.
*G10L 21/02* (2006.01)

(52) U.S. Cl. ..... 704/226; 704/216; 704/223; 704/228

(58) Field of Classification Search ..... 704/226, 704/216, 223, 228
See application file for complete search history.

(56) References Cited

U.S. PATENT DOCUMENTS 5,475,712 A 12/1995 Sasaki ..... 375/241
5,537,509 A 7/1996 Swaminathan et al. .... 395/2.37
5,563,944 A * 10/1996 Hasegawa ..... 379/406.04
5,630,016 A 5/1997 Swaminathan et al. .... 395/2.37
5,646,991 A * 7/1997 Sih ..... 379/406.08
5,794,199 A 8/1998 Rao et al. ..... 704/258
5,862,452 A * 1/1999 Cudak et al. ..... 725/81
5,893,056 A 4/1999 Saikaly et al. ..... 704/226
5,949,888 A 9/1999 Gupta et al. ..... 381/66
5,960,389 A 9/1999 Jarvinen et al. ..... 704/220
5,978,760 A 11/1999 Rao et al. ..... 704/226
6,101,466 A 8/2000 Rao et al. ..... 704/233
6,108,623 A * 8/2000 Morel ..... 704/219
6,163,608 A * 12/2000 Romesburg et al. ... 379/406.01
6,185,300 B1 * 2/2001 Romesburg ..... 379/406.09
6,424,942 B1 7/2002 Mustel et al. ..... 704/233
6,597,787 B1 * 7/2003 Lindgren et al. ..... 379/406.05
6,816,592 B1 * 11/2004 Kirla ..... 379/406.05

* cited by examiner

*Primary Examiner*—Richemond Dorvil
*Assistant Examiner*—Qi Han

(57) ABSTRACT

A comfort noise generator (104) suitable for use in a communication system includes a finite impulse response (FIR) filter (136), a random number generator (140), and a coefficient updater (138). The coefficient updater (138) determines an updated set of filter coefficients (142) based on the signal frame of the input signal (102). The updated set of filter coefficients (142) is output to the FIR filter (136). The FIR filter (136) shapes a white noise signal (146) supplied by the random number generator (140) to provide a simulated background noise signal, or comfort noise signal (122). The comfort noise signal (122) is selectively output from an echo suppression system or corresponding method to overwrite or suppress reflected residual echoes.

22 Claims, 2 Drawing Sheets

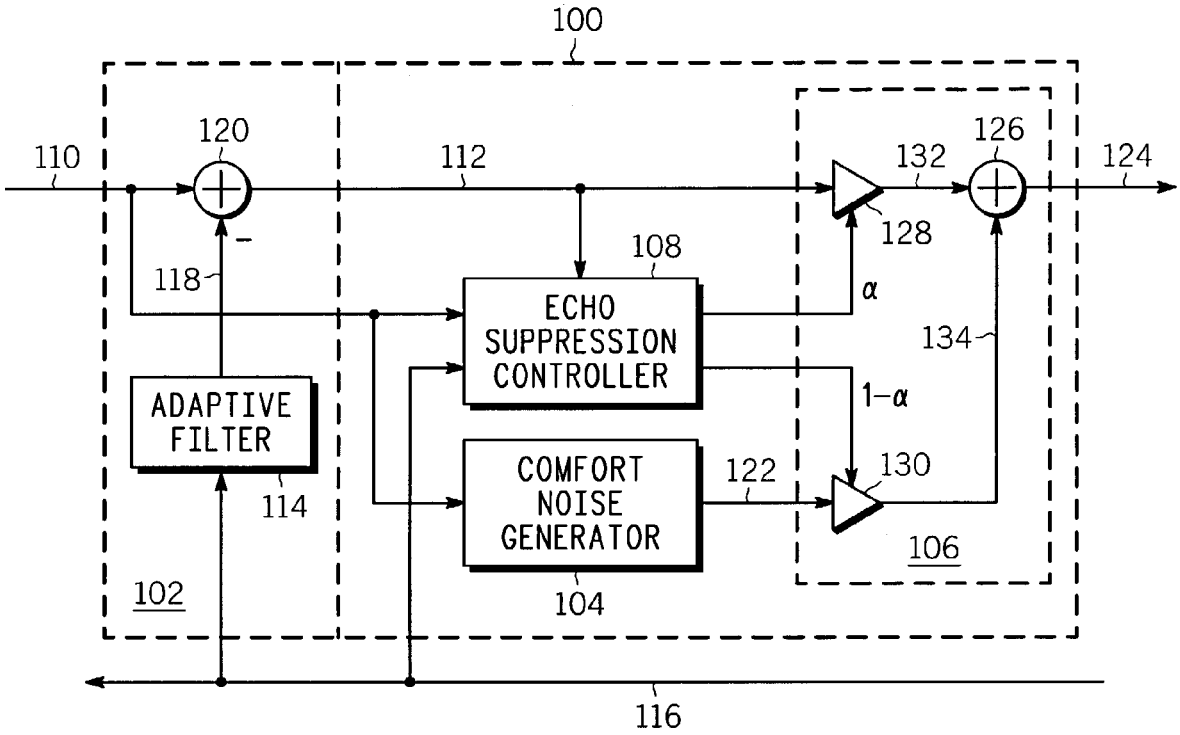
FIG. 1
FIG. 2
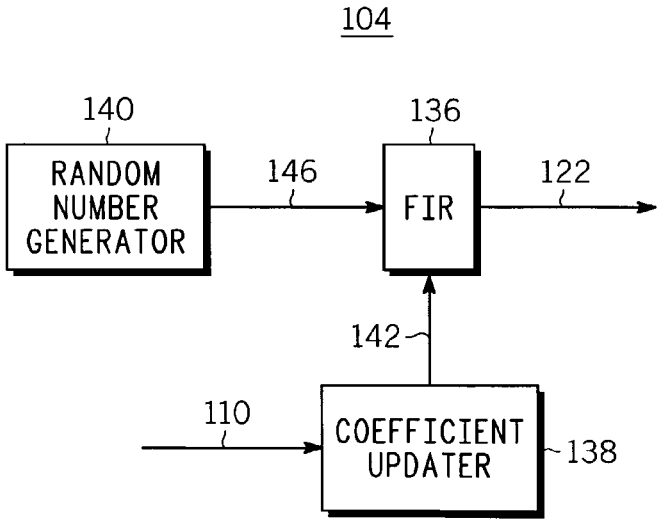

LOW-COMPLEXITY COMFORT NOISE GENERATOR

FIELD OF THE INVENTION

This invention relates in general to hands-free communication devices, and more specifically to a method and apparatus for echo suppression within such devices.

BACKGROUND OF THE INVENTION

An echo control system in a hands-free communication device attenuates a signal path between the microphone and the speaker to reduce the echoes experienced by a far-end user. However, due to inherent nonlinearities, acoustic echo cancellers used in such systems only provide between 25 dB and 30 dB of attenuation in the signal path. This attenuation may be insufficient and may allow residual echoes to be reflected back to the far-end when only a far-end user is actively producing audio signals. Therefore, the introduction of additional attenuation into the signal path during far-end only activity is necessary.

In addition to attenuation, many systems will insert simulated background or comfort noise using parameters generated from speech compression algorithms. The near-end hands-free communication device extracts parameters from current background noise and transmits these parameters to the far-end hands-free communication device across a narrow-band channel. The far-end hands-free communication device then reconstructs the noise from the parameters as it receives them. However, speech compression algorithms require additional and relatively complex processing and therefore increase overall system costs for the creation of bandwidth-efficient parameters.

Background noise can alternatively be simulated using an echo suppressor that locally generates what is known as comfort noise that closely approximates the background noise. The comfort noise is output simultaneously with the audio signal transmitted over the hands-free communications device to replace the background audio signal. This eliminates the need for bandwidth efficiency as the parameters are locally generated and used. However, one problem with such an echo suppressor is that parameters must be extracted from the current frame of background noise that also contains the echo. Another problem with such an echo suppressor is that it is necessary to span arbitrarily long periods of time without updating the parameters. This can cause undesirable clicking noises if done improperly.

An echo suppressor that uses an infinite impulse response (IIR) filter for comfort noise generation is known. Such an echo suppressor, which uses linear predictive coding (LPC) and synthesis codebooks, eliminates the problem of extracting parameters from a frame of background noise containing the echo. However, this type of echo suppressor requires complex LPC and therefore has large memory and computational requirements.

Therefore, what is needed is an echo suppressor for use in a hands-free communications device that provides high quality echo cancellation while maintaining low memory and computational requirements.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1 depicts, in a simplified and representative form, a block diagram of a system suitable for utilization of various embodiments according to the present invention;

FIG. 2 depicts, in a representative form, a block diagram of a preferred embodiment of a comfort noise generator according to the present invention.

DETAILED DESCRIPTION OF PREFERRED EMBODIMENT

Figure 3:
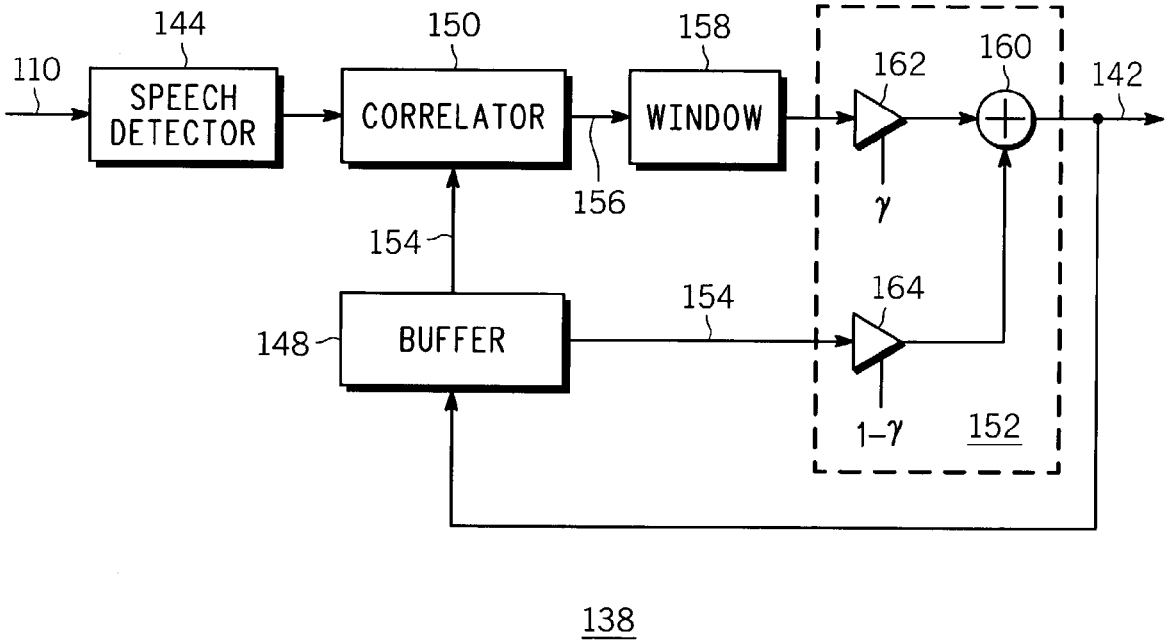
FIG. 3 illustrates a more detailed block diagram of a preferred embodiment of a portion of the FIG. 2 comfort noise generator according to the present invention.

In overview form the present disclosure concerns hands-free communications devices, and more specifically a method and apparatus for echo suppression within such devices. More particularly, various inventive concepts and principles that improve the performance and reduce the complexity and processing resources required by such methods and apparatus are discussed. The echo suppression systems and methods of particular interest are those that produce a simulated background noise signal, or comfort noise signal, to overwrite echoes. The echo suppression system and comfort noise generator therein are contemplated for use in wireless communications devices such as cellular phones but could be used in any communications device capable of operating in a hands-free or speakerphone mode in which echo suppression is desired.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued. It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in software programs or instructions and integrated circuits. It is expected that one of ordinary skill, notwithstanding possibly significant effort and many design choices motivated by, for example, available time, current technology, and economic considerations, when guided by the concepts and principles disclosed herein will be readily capable of generating such software instructions or programs and integrated circuits with minimal experimentation. Therefore, in the interest of brevity and minimization of any risk of obscuring the principles and concepts according to the present invention, further discussion of such software and integrated circuits, if any, will be limited to the essentials with respect to the principles and concepts employed by the preferred embodiments.

Referring to the figures and specifically to FIG. 1, a simplified and representative block diagram of an echo suppression system 100 suitable for utilization of various embodiments according to the invention will be discussed and described. The echo suppression system 100 is for use in a wireless communications device such as a CDMA or GSM cellular telephone, and is specifically contemplated for use in such a device that can be operated in a hands-free or speakerphone mode. The echo suppression system 100 may be realized through software implemented within a digital signal processor (DSP) such as, for example, the HAWK 56800, commercially available from Motorola. Alternatively, the echo suppression system 100 may be realized through hardware such as, for example, a digital hardware application specific integrated circuit (ASIC). Regardless of its specific implementation, the echo suppression system 100 includes an acoustic echo canceller (AEC) 102, a comfort noise generator 104, a soft switch 106 and an echo suppression controller 108. The makeup and function of each of these components will now be discussed in detail.

The AEC 102 is for receiving a digital audio, or digital input, signal 110, for removing estimated echoes from the digital input signal 110, and for outputting a modified digital audio signal 112 (hereinafter referred to as modified input signal 112). The digital input signal 110 (hereinafter referred to as input signal 110) is an inbound signal from a telephone near-end or local microphone (not shown) that has been converted into digital samples by a conventional A/D converter (not shown) and grouped into digital input signal frames (hereinafter referred to as signal frames) in a manner well known in the art. Each signal frame includes a predetermined number of samples such as, for example, 80 samples. The input signal 110 can be a digital background noise signal that includes digital background noise signal frames or a digital voice signal that includes digital voice signal frames.

The AEC 102 includes an adaptive filter 114 that receives a far-end receive signal (receive signal) 116 and produces an estimated echo signal 118 based on the receive signal 116. Preferably, the AEC 102 uses an adder 120 to subtract the estimated echo signal 118 from the input signal 110 to therefore produce and output the modified input signal 112.

The echo suppression controller 108 is for receiving the input signal 110 and the receive signal 116 and for controlling the soft switch 106 based upon the input signal 110 and the receive signal 116 according to well known algorithms. The echo suppression controller 108 could also receive the modified signal 112 from the AEC 102 and control the soft switch 106 based upon the input signal 110, the receive signal 116, and the modified signal 112. Specifically, during periods of only far-end audio activity, the echo suppression controller 108 instructs the soft switch 106 to output what will be referred to as a comfort noise signal, a simulated background noise signal, or, more generally, a simulated signal, 122 produced by the comfort noise generator 104 as a transmit output signal 124. During periods of only near-end or local audio activity, the echo suppression controller 108 instructs the soft switch 106 to output the modified input signal 112 as the transmit output signal 124. The receive signal 116 is a signal transmitted to a near-end speaker (not shown) after being converted into an audio signal by a conventional D/A converter (not shown). The receive signal 116 may also undergo additional processing before being converted to an analog signal and being output to the near-end speaker.

The soft switch 106, which is of the type known in the art and can be implemented in a number of conventional ways, is for switching between the modified input signal 112 and the comfort noise signal 122 produced by the comfort noise generator 104 to output the transmit output signal 124. The soft switch 106 is able to gradually switch between the modified input signal 112 and the comfort noise signal 122 to avoid audible clicks or abrupt cut-offs in the transmit output signal 124 that are noticeable to the far-end user. The soft switch 106 preferably includes an adder 126 and first and second variable-gain attenuators 128, 130 that are coupled to or in communication with the echo suppression controller 108. Based upon the levels of the input signal 110 and the receive signal 116, the echo suppression controller 108 determines an attenuation factor $\alpha$ and outputs signals representative of the attenuation factor $\alpha$ and an inverse attenuation factor $1-\alpha$ to the first and second variable-gain attenuators 128 and 130, respectively.

The first variable-gain attenuator 128 attenuates the modified input signal 112 based on the attenuation factor a to produce a first attenuated signal 132. The second variable-gain attenuator 130 attenuates the comfort noise signal 122 based on the inverse attenuation factor $1-\alpha$ to produce a second attenuated signal 134. The adder 126 combines the first attenuated signal 132 and the second attenuated signal 134 to form the transmit output signal 124. Therefore, during periods of only far-end audio activity when the input signal 110 at the near-end contains an echo signal, the echo suppression controller 108 determines the value of the attenuation factor $\alpha$ to be zero, so that the soft switch 106 outputs the comfort noise signal 122. During periods of only near-end or local audio activity when the input signal 110 is a digital voice signal, the echo suppression controller 108 determines the value of the attenuation factor a to be one, so that the soft switch 106 outputs the modified input signal 112. The soft switch 106 may gradually switch between the comfort noise signal 122 and the modified input signal 112 if the attenuation factor a approaches zero or one, causing the inverse attenuation factor $1-\alpha$ to approach one or zero. For example, when the near-end user is talking, the input signal 110 is a digital voice signal. The modified input signal 112 is therefore multiplied by one, the comfort noise signal 122 is multiplied by zero and the transmit output signal 124 thus includes only the modified input signal 112. When the near-end user stops talking and the far-end user is talking, the input signal 110 includes echo, and the attenuation factor $\alpha$ may ramp from one to zero, thus causing the inverse attenuation factor $1-\alpha$ to ramp from zero to one. As the attenuation factor a ramps from one to zero, the transmit output signal 124 changes from including only the modified input signal 112 to including both the modified input signal 112 and the comfort noise signal 122 in inversely proportional amounts, to ultimately include only the comfort noise signal 122 when there is only far-end audio activity.

It should be noted that the method of controlling the soft switch 106 using the echo suppression controller 108 could be performed by any number of algorithms or hardware implementations in addition to the implementation of the soft switch 106.

As mentioned above, however, the AEC 102 may not provide sufficient attenuation for the echo suppression system 100 and therefore may not cancel a sufficient amount of echo in the input signal 110. If the receive signal 116 has not been sufficiently attenuated, the far-end user may experience reflected residual echoes during periods of talk where only the far-end user is actively generating audio signals. Therefore, as will now be discussed, the soft switch 106 provides the necessary additional attenuation and inserts comfort noise from the comfort noise generator 104.

Referring to FIG. 1 and FIG. 2, a block diagram of a preferred embodiment of the comfort noise generator 104 will be discussed and described. The comfort noise generator 104 is for generating the simulated background noise signal, or comfort noise signal 122, when the input signal 110 includes echo and does so through the use of a finite impulse response (FIR) filter 136. The comfort noise signal 122 is then input to the soft switch 106 for reasons discussed above.

The determination of the FIR filter coefficients is much simpler and therefore requires less memory and computational power than the linear predictive coding used in conventional echo suppression systems such as those including IIR filters. As shown specifically in FIG. 2, the comfort noise generator 104 includes a coefficient updater 138 and a random number generator 140 in addition to the FIR filter 136. The structure and function of each of these components will now be discussed in detail.

The coefficient updater 138 is for receiving a signal frame of the input signal 110 and for generating and outputting an updated set of filter coefficients 142 to the FIR filter 136. The coefficient updater 138 may include a speech detector 144 (FIG. 3) for detecting the levels of the signal frame. The speech detector 144 is also for determining if the levels of the signal frame are within a predetermined threshold representative of a noise energy of a voice signal such as, for example, ±0.5 dB of a continuously measured noise floor. Therefore, if the signal frame is within the threshold, the input signal 110 contains essentially no echo or speech and is considered a digital background noise signal. For the present discussion, it is assumed that the input signal 110 is a digital background noise signal.

The random number generator 140 is of the type known in the art and can be implemented in a number of conventional ways. For example, the random number generator 140 may be a 16 bit linear feedback shift register that provides a white noise signal 146 to the FIR filter 136. Using the updated set of filter coefficients 142 provided by the coefficient updater 138, the FIR filter 136 produces the comfort noise signal 122 by shaping the noise signal 146 to correspond to the input signal 110.

Referring to FIG. 3, the coefficient updater 138 includes a buffer 148, a correlator 150 and an integrator 152. As shown, the buffer 148 is for queuing a current set of filter coefficients 154 that have been generated and output by the coefficient updater 138 and for outputting or providing the coefficients to the correlator 150 and to the integrator 152 in a manner that will be described below.

The correlator 150 is for receiving the current set of filter coefficients 154 from the buffer 148 and for correlating the signal frame of the input signal 110 with the current set of filter coefficients 154 to obtain a best fit subframe 156 of the signal frame. Cross correlation values xx[k] equal the sum over n from 0 to 49 of the product y[n+k] h[n], where y[n] is the signal frame of the input signal 110, h[n] is the current set of filter coefficients 154, and k is the position of the 50 coefficients within the possible 80 data samples and ranges from 0 to 29. This calculation is performed once per frame, or once per 80 samples, to obtain the best fit subframe 156, or in other words the best 50 consecutive samples, from the signal frame of the input signal 110. Of the 30 possible positions of the 50 consecutive samples, the best position and thus the best fit subframe 156 is the position which provides the largest cross correlation value xx[k]. As mentioned above, the coefficient updater 138 may include the speech detector 144 for detecting the levels of the signal frame. If the levels of the signal frame are within the threshold, the speech detector 144 instructs the correlator 150 to correlate the signal frame with the current set of filter coefficients 154 to obtain the best fit subframe 156.

The correlator 150 is also for outputting the best fit subframe 156, which may then be shaped by a window 158 before it is input into the integrator 152. The window 158 is a spectral estimate enhancement window and is preferably a Hanning window, but could also be a Hamming window, a Blackman window or another similar window that serves to smooth or shape the spectrum of the best fit subframe 156 as is well known in the art. It is beneficial that the best fit subframe 156 be smoothed in the window 158 to provide the best spectral estimate.

The integrator 152 is for combining the best fit subframe 156 of the signal frame of the input signal 110 with the current set of filter coefficients 154 received from the buffer to produce the updated set of filter coefficients 142. Alternately, the integrator 152 may combine the best fit subframe 156 with a linear combination of previous sets of filter coefficients to produce the updated set of filter coefficients 142. The integrator 152 is also for outputting the updated set of filter coefficients 142 to the FIR filter 136 and buffer 148 to replace the current set of filter coefficients 154.

The integrator 152 is known in the art and can be implemented in a number of conventional ways. For example, the integrator 152 may include an adder 160 and first and second attenuators 162, 164 in communication with the adder 160. The first attenuator 162 attenuates the best fit subframe 156 of the signal frame based on a predetermined attenuation factor $\gamma$. The second attenuator 164 attenuates the current set of filter coefficients 154 by a second predetermined attenuation factor that is the inverse of the first predetermined attenuation factor, or $1-\gamma$. The outputs from the first and second attenuators 162 and 164 are input to the adder 160 where the outputs are combined to produce the updated set of filter coefficients 142. The updated set of filter coefficients 142 is then output to the FIR filter 136 and to the buffer 148 to replace the current set of filter coefficients 154.

Referring to FIGS. 1-3, exemplary operation of the echo suppression system 100 will now be discussed in detail. The input signal 110 is input through a telephone near-end microphone (not shown), converted into digital samples and grouped into signal frames as discussed above. The input signal 110-is input to the AEC 102, where estimated echoes are removed to produce the modified input signal 112.

The echo suppression controller 108 detects the levels of the signal frames of the input signal 110. If the echo suppression controller 108 determines that the input signal 110 is a digital voice signal (the near-end user is speaking), the echo suppression controller 108 instructs the soft switch 106 to output the modified input signal 112 as the transmit output signal 124 as described above. The soft switch 106 performs this selective switching by attenuating the modified input signal 112 by the attenuation factor a determined by the echo suppression controller 108, attenuating the comfort noise signal 122 by the inverse attenuation factor $1-\alpha$ and combining the attenuated signals 132, 134. As discussed above, the soft switch 106 may gradually switch between the comfort noise signal 122 and the modified input signal 112.

The comfort noise generator 104 receives the input signal 110 and approximates the input signal 110 using the random number generator 140 and the FIR filter 136. The speech detector 144 may detect the levels of the signal frames to determine if the levels of the signal frames are within a predetermined threshold. If not, the FIR filter 136 uses an initial set of coefficients or the set of coefficients it used to produce the previous comfort noise signal 122. If the levels of the signal frames are within the predetermined threshold, the input signal 110 is a digital background noise signal and the speech detector 144 instructs the correlator 150 to correlate a current set of filter coefficients 154 with the signal frame to determine the best fit subframe 156 of the input signal 110. The best fit subframe 156 may be conditioned by the window 158 and then combined with the current set of coefficients 154 to produce an updated set of coefficients 142 in an integrator using first and second attenuators 162, 164 and the adder 160.

The updated set of filter coefficients 142 is output to the FIR filter 136, which uses these coefficients to condition the white noise signal 146 produced by the random number generator 140 to produce the comfort noise signal 122 that is output to the soft switch 106. Therefore, if the levels of the signal frames are within a threshold such as, for example, 0.5 dB of a continuously measured noise floor, the current set of coefficients 154 is replaced with the updated set of coefficients 142. The echo suppression controller 108, rather than the comfort noise generator 104, determines whether the comfort noise signal 122 is output as the transmit output signal 124. Therefore, the comfort noise generator 104 always produces the comfort noise signal 122. However, if the input signal 110 is not a digital background noise signal, the coefficients are not updated.

As discussed above, the soft switch 106 produces a transmit output signal 124 by outputting either the comfort noise signal 122 output by the FIR filter 136 of the comfort noise generator 104 or the modified input signal 112 depending upon the levels of the input signal 110 as determined by the echo suppressor controller 108. Therefore, the comfort noise signal 122 is only output as the transmit output signal 124, and effectively the comfort noise generator 104 is only used when the far-end user is speaking. The receive signal 116 is then converted to an analog signal and output to the near-end speaker. Therefore, when a far-end user is actively producing audio signals and the near-end user is not actively producing audio signals, the comfort noise generator 104 outputs the comfort noise signal 122 that the far-end user hears. The comfort noise signal 122 consequently replaces the residual echo.

In summary, the echo suppression system 100 provides additional attenuation in the signal path between the speaker and the microphone of a hands-free communication device to reduce the echoes experienced by a far-end user through use of a comfort noise generator 104. Specifically, the comfort noise generator 104 is able to replace the missing background noise signal by generating the comfort noise signal 122 shown in FIGS. 2 and 3, by shaping the white noise signal 146 using filter coefficients based on the input signal 110. Therefore, the echo suppression system 100 provides a minimally complex, yet effective, system for eliminating echoes.

The processes discussed above and the inventive principles thereof are intended to and will alleviate insufficient attenuation problems caused by prior art echo suppression systems. In addition, the comfort noise generator of the present invention will enhance echo suppression while advantageously requiring lower memory and computational requirements than prior art comfort noise generators.

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A comfort noise generator for an echo suppression system comprising:

a finite impulse response (FIR) filter;

a coefficient updater for receiving a digital signal frame and for generating and outputting an updated set of filter coefficients to the FIR filter, the updated set of filter coefficients depending on a best fit subframe of the digital signal frame and a current set of filter coefficients; and a random number generator for generating a white noise signal and for outputting the white noise signal to the FIR filter, the FIR filter for shaping the white noise signal to correspond to the digital signal frame based on the updated set of filter coefficients received from the coefficient updater provide a comfort noise signal from said FIR filter to the echo suppression system.

2. The comfort noise generator of claim 1, wherein the digital signal frame is a digital background noise signal frame.

3. The comfort noise generator of claim 1, wherein the coefficient updater further comprises:

a buffer for queuing and outputting a current set of filter coefficients;

a correlator connected to the buffer for receiving the current set of filter coefficients from the buffer, for correlating the digital signal frame with the current set of filter coefficients to determine the best fit subframe of the digital signal frame, and for outputting the best fit subframe of the digital signal frame; and an integrator for combining the best fit subframe of the digital signal frame with the current set of filter coefficients to produce and output the updated set of filter coefficients to the FIR filter.

4. The comfort noise generator of claim 3, wherein the coefficient updater further comprises a speech detector coupled to the correlator, the speech detector for detecting the levels of the digital signal frame.

5. The comfort noise generator of claim 3, wherein the integrator is for combining the best fit subframe of the digital signal frame with a linear combination of previous sets of filter coefficients to produce the updated set of filter coefficients.

6. The comfort noise generator of claim 3, wherein the digital signal frame comprises a set of 80 data samples and the current set of filter coefficients comprises a set of 50 data samples.

7. The comfort noise generator of claim 3, wherein the coefficient updater further comprises:

a window for receiving and conditioning the best fit subframe of the digital signal frame from the correlator and for outputting the best fit subframe of the digital signal frame to the integrator.

8. The comfort noise generator of claim 7, wherein the window is a spectral estimate enhancement window.

9. The comfort noise generator of claim 3, wherein the integrator further comprises:

a first attenuator for receiving the best fit subframe of the digital signal frame from the correlator and for attenuating the best fit subframe of the digital signal frame by a first attenuation factor;

a second attenuator for receiving the current set of filter coefficients from the buffer and for attenuating the current set of filter coefficients by a second attenuation factor; and an adder for combining the best fit subframe of the digital signal frame that has been attenuated by the first attenuation factor with the current set of filter coefficients that has been attenuated by the second attenuation factor to produce the updated set of filter coefficients, and for outputting the updated set of filter coefficients to the buffer to replace the current set of filter coefficients.

10. The comfort noise generator of claim 4, wherein the correlator correlates the digital signal frame with the current set of filter coefficients to determine a best fit subframe of the digital signal frame when the speech detector detects that the digital background noise signal frame is below a predetermined threshold.

11. The comfort noise generator of claim 10, wherein the predetermined threshold corresponds to a noise energy of a voice signal.

12. The comfort noise generator of claim 11, wherein the predetermined threshold is within 0.5 dB of a continuously measured noise floor.

13. The comfort noise generator of claim 1, wherein the random number generator comprises a 16-bit linear feedback shift register.

14. An echo suppression system for a communications device comprising:

an acoustic echo canceller for receiving a digital audio signal, for removing estimated echoes from the digital audio signal, and for outputting a modified digital audio signal;

a comfort noise generator including a finite impulse response (FIR) filter for receiving the digital audio signal and for approximating the digital audio signal to produce a simulated signal, the comfort noise generator further comprising a coefficient updater for receiving the digital audio signal and for generating and outputting an updated set of filter coefficients to the FIR filter, the undated set of filter coefficients depending on a best fit portion of the digital audio signal and a current set of filter coefficients;

a soft switch for switching between the modified digital audio signal and the simulated signal to output a transmit output signal; and an echo suppression controller for receiving the digital audio signal and a far-end receive signal and for controlling switching of the soft switch between the modified digital audio signal and the simulated signal based on values of the digital audio signal and the far-end receive signal.

15. The echo suppression system of claim 14, wherein the echo suppression controller is further for determining an attenuation factor based on levels of the digital audio signal and the far-end receive signal and for outputting a signal representative of the attenuation factor and a signal representative of an inverse attenuation factor.

16. The echo suppression system of claim 15, wherein the soft switch further comprises:

a first variable gain attenuator for receiving the signal representative of the attenuation factor from the echo suppression controller, for receiving the modified digital audio signal from the acoustic echo canceller, and for attenuating the modified digital audio signal based on the attenuation factor to produce a first attenuated signal;

a second variable gain attenuator for receiving the signal representative of the inverse attenuation factor from the echo suppression controller, for receiving the simulated signal from the comfort noise generator, and for attenuating the simulated signal based on the inverse attenuation factor to produce a second attenuated signal; and an output adder in communication with the first and second variable gain attenuators for combining the first attenuated signal and the second attenuated signal to produce the transmit output signal.

17. A method for suppressing echoes in a communications device, the method comprising:

receiving a digital audio signal;

removing estimated echoes from the digital audio signal to provide a modified digital audio signal;

generating a simulated signal using a comfort noise generator comprising a random number generator and a finite impulse response (FIR) filter; and selectively switching between the modified digital audio signal and the simulated signal to produce a transmit output signal, wherein the generating a simulated signal further comprises:

queuing a current set of filter coefficients;

correlating the digital audio signal with the current set of filter coefficients to determine a best fit subframe of the digital audio signal: and combining the best fit subframe of the digital audio signal and a current set of filter coefficients to produce an undated set of filter coefficients.

18. The method of claim 17, wherein the selectively switching between the modified digital audio signal and the simulated signal further comprises:

attenuating the modified digital audio signal by an attenuation factor;

attenuating the simulated signal by an inverse attenuation factor; and combining the attenuated modified digital audio signal and the attenuated simulated signal to produce the transmit output signal.

19. The method of claim 17, wherein the generating a simulated signal using a comfort noise generator comprising a random number generator and a FIR filter further comprises attenuating the best fit subframe of the digital audio signal and the current set of filter coefficients before combining the best fit subframe of the digital audio signal and the current set of filter coefficients.

20. The method of claim 19, wherein the generating a simulated signal using a comfort noise generator comprising a random number generator and a FIR filter further comprises conditioning the best fit subframe of the digital audio signal before attenuating the best fit subframe of the digital audio signal.

21. The method of claim 17, wherein the generating a simulated signal using a comfort noise generator comprising a random number generator and a FIR filter further comprises replacing the current set of filter coefficients with the updated set of filter coefficients when the digital audio signal is within a predetermined threshold.

22. The method of claim 21, wherein the generating a simulated signal using a comfort noise generator comprising a random number generator and a FIR filter further comprises replacing the current set of filter coefficients with the updated set of filter coefficients when the digital audio signal is within 0.5 dB of a continuously measured noise floor.

* * * * *

UNITED STATES PATENT AND TRADEMARK OFFICE

CERTIFICATE OF CORRECTION

PATENT NO. : 7,243,065 B2
APPLICATION NO. : 10/408996
DATED : July 7, 2007
INVENTOR(S) : Stephens et al.

It is certified that error appears in the above-identified patent and that said Letters Patent is hereby corrected as shown below:

Column 8 line 27 after “coefficient updater” please insert --to--

Signed and Sealed this

Twentieth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,243,065 B2
APPLICATION NO. : 10/408996
DATED : July 10, 2007
INVENTOR(S) : Stephens et al.

It is certified that error appears in the above-identified patent and that said Letters Patent is hereby corrected as shown below:

Column 8 line 27 after "coefficient updater" please insert --to--

This certificate supersedes Certificate of Correction issued November 20, 2007.

Signed and Sealed this

Twenty-fifth Day of December, 2007

JON W. DUDAS
*Director of the United States Patent and Trademark Office*